US008815024B2

(12) United States Patent
Asahi et al.

(10) Patent No.: US 8,815,024 B2
(45) Date of Patent: Aug. 26, 2014

(54) STEEL PLATE OR STEEL PIPE WITH SMALL OCCURRENCE OF BAUSCHINGER EFFECT AND METHODS OF PRODUCTION OF SAME

(75) Inventors: Hitoshi Asahi, Futtsu (JP); Eiji Tsuru, Futtsu (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 710 days.

(21) Appl. No.: 10/588,837

(22) PCT Filed: Feb. 15, 2005

(86) PCT No.: PCT/JP2005/002678

§ 371 (c)(1),
(2), (4) Date: Aug. 8, 2006

(87) PCT Pub. No.: WO2005/080621

PCT Pub. Date: Sep. 1, 2005

(65) Prior Publication Data

US 2008/0286504 A1 Nov. 20, 2008

(30) Foreign Application Priority Data

Feb. 19, 2004 (JP) ..... 2004-042838
Sep. 6, 2004 (JP) ..... 2004-258862

(51) Int. Cl.
*C22C 38/00* (2006.01)
*C22C 38/06* (2006.01)
*C22C 38/58* (2006.01)

(52) U.S. Cl.
USPC ..... 148/328; 148/330; 148/335; 420/109

(58) Field of Classification Search
USPC ..... 148/400, 320, 516, 519–521, 559, 566, 148/567, 570, 571, 579, 590–594, 601–603, 148/622–624, 639–654, 656–664, 148/328–337; 420/8, 120, 129, 590; 219/607–617, 629, 643, 644, 59.1, 219/60 R, 60.2, 61, 60 A, 535
IPC ..... C12D 8/10,9/08, 9/50; C22C 38/02, C22C 38/04, 38/06
See application file for complete search history.

(56) References Cited

U.S. PATENT DOCUMENTS 4,067,756 A 1/1978 Koo et al.
4,437,902 A 3/1984 Pickens et al.
4,772,771 A 9/1988 Murayama et al.

FOREIGN PATENT DOCUMENTS

EP 1 382 703 A2 1/2004
JP 58-217628 12/1983

(Continued)
OTHER PUBLICATIONS

JP 2000-212680. English abstract and English machine translation.*

(Continued)

*Primary Examiner* — Scott Kastler
*Assistant Examiner* — Vanessa Luk
(74) *Attorney, Agent, or Firm* — Kenyon & Kenyon LLP

(57) ABSTRACT

The present invention provides steel plate or steel pipe with small occurrence of the Bauschinger effect and methods of production of the same, particularly steel pipe used for steel pipe for oil wells or line pipe with a small drop in the compression strength in the circumferential direction due to the Bauschinger effect when expanded and methods of production of the same, that is steel plate or steel pipe with small occurrence of the Bauschinger effect characterized by having a dual-phase structure substantially comprising a ferrite structure and fine martensite which is dispersed in the ferrite structure. Further, this steel plate or steel pipe contains, by mass %, C: 0.03 to 0.30%, Si: 0.01 to 0.8%, Mn: 0.3 to 2.5%, P: 0.03% or less, S: 0.01% or less, Al: 0.001 to 0.01%, and N: 0.01% or less and a balance of iron and unavoidable impurities.

4 Claims, 5 Drawing Sheets

(56) References Cited

FOREIGN PATENT DOCUMENTS

| | | | | |
|---|---|---|---|---|
| JP | 59-47323 | | | 3/1984 |
| JP | 04-268016 | | | 9/1992 |
| JP | 9-3545 | | | 1/1997 |
| JP | 9-49025 | | | 2/1997 |
| JP | 9-49050 | A | | 2/1997 |
| JP | 10-176239 | A | | 6/1998 |
| JP | 2000-212680 | | * | 8/2000 |
| JP | 2001-355035 | | | 12/2001 |
| JP | 2002-129283 | | | 5/2002 |
| JP | 2002-212680 | | | 7/2002 |
| JP | 2002-266055 | | | 9/2002 |
| JP | 2002-349177 | | | 12/2002 |
| JP | 2003-3229 | | | 1/2003 |
| JP | 2003-96545 | | | 4/2003 |
| JP | 2003-201543 | | | 7/2003 |
| JP | 2004-35925 | | | 2/2004 |

OTHER PUBLICATIONS

English abstract and machine translation of JP 10-176239.*

Bates, Charles E.; Totten, George E.; Brennan, Robert L. "Quenching of Steel," vol. 4: Heat Treating, ASM Handbooks Online, ASTM International, 2002. (49 pages total).*

Computer-Generated Translation of JP 2003-096545 (Kami et al.), published in the Japanese language on Apr. 3, 2003.*

G.R. Speich, "Dual-Phase Steels," Properties and Selection: Irons, Steels, and High-Performance Alloys, vol. 1, ASM Handbook, ASM International, 1990, originally found on pp. 424-429, electronic version: 3 pages total.*

European Search Report dated Aug. 21, 2009 issued in corresponding European Application No. 05 71 0460.

* cited by examiner

STEEL PLATE OR STEEL PIPE WITH SMALL OCCURRENCE OF BAUSCHINGER EFFECT AND METHODS OF PRODUCTION OF SAME

TECHNICAL FIELD

The present invention relates to steel plate or steel pipe with small occurrence of the Bauschinger effect and methods of production of the same, more particularly relates to steel pipe used for steel pipe for oil wells or line pipe with a small drop in the compression strength in the circumferential direction when expanded 5% or more, that is, with a small occurrence of the Bauschinger effect, and methods of production of the same.

BACKGROUND ART

When tensile plastic strain is introduced into steel pipe in the circumferential direction by expansion of the pipe, the yield strength with respect to compressive stress in the circumferential direction due to external pressure (below, the "compressive yield strength") falls and the pressure at which the steel pipe is crushed by external pressure (below, the "crushing pressure") falls. The phenomenon arises, as is well known as the "Bauschinger effect", where after plastic deformation, if applying stress in the opposite direction to the direction in which the plastic deformation was applied, deformation occurs at a lower stress than the original yield strength.

In UOE steel pipe used as line pipe, the pipe is expanded to increase the circularity in the final step. Since tensile plastic strain is introduced in the circumferential direction, there is the problem that the crushing pressure falls. Further, when cold working and using steel plate as well, for example, when applying tensile strain, the compressive yield stress falls and the Bauschinger effect otherwise becomes a problem.

For example, methods using heat treatment to restore the compressive yield strength dropping due to the Bauschinger effect arising due to the cold working strain introduced in the process of production of UOE steel pipe are disclosed in Japanese Patent Publication (A) No. 9-3545 and Japanese Patent Publication (A) No. 9-49025. Japanese Patent Publication (A) No. 9-3545 discloses the method of shaping steel plate by a U-press and O-press into a pipe shape, welding it, expanding it, and heating it to less than 700° C., while Japanese Patent Publication (A) No. 9-49025 discloses the method of further plastically working the pipe by hot working to expand it.

Further, Japanese Patent Publication (A) No. 2004-35925 discloses a method of production of steel pipe enabling recovery of the compressive yield strength falling due to the Bauschinger effect even when reducing the heating temperature to 550° C. or less, particularly 250° C. or less. Further, steel pipes with small occurrence of the Bauschinger effect due to strain introduced at the time of pipemaking and methods of production of the same are disclosed in Japanese Patent Publication (A) No. 9-49050, Japanese Patent Publication (A) No. 10-176239, and Japanese Patent Publication (A) No. 2002-212680.

However, the strain introduced at the time of pipemaking disclosed in these inventions is about 1 to 3% in range or at most 4% or less. The Bauschinger effect on steel plate and steel pipe into which 5% or more of strain is introduced is unclear.

Under the circumstances, in recent years, for example, the technology for use expanded 10 to 30% in oil wells or gas wells (expandable tubular technology) has been developed.

The Bauschinger effect on steel plate and steel pipe into which high strain is introduced is therefore becoming an issue. The expandable tubular technology reduces the drilling costs by expanding the oil well steel pipe, which had been inserted into wells and used as is in the past, in the oil wells or gas wells.

Steel pipes able to be used for this expandable tubular technology are disclosed in, for example, Japanese Patent Publication (A) No. 2002-266055, Japanese Patent Publication (A) No. 2002-129283, and Japanese Patent Publication (A) No. 2002-349177. However, these are steel pipes excellent in pipe expandability and crushing strength and corrosion resistance after expansion. Nothing is disclosed about the drop in the crushing strength due to the Bauschinger effect arising due to the introduction of strain envisioning expansion in oil wells.

That is, there have been almost no discoveries regarding the optimum microstructure of steel for suppressing the occurrence of the Bauschinger effect in steel plate into which 5% or more of strain is introduced by cold working or in steel pipe to which 10 to 30% of strain is introduced when expanding oil well pipe inside the oil wells.

DISCLOSURE OF THE INVENTION

The present invention provides steel plate and steel pipe into which 5% or more of tensile strain is introduced and having a small drop in yield strength in the compression direction, in particular steel pipe with a small occurrence of the Bauschinger effect suitable for applications subject to external pressure after being expanded 10% or more in an oil well or a gas well and, further, provides methods of production of the same.

The inventors studied in detail the effects of the microstructure and chemical ingredients on the occurrence of the Bauschinger effect and as a result discovered that when introducing 5% or more strain, to reduce the occurrence of the Bauschinger effect, it is best to make the structure of the steel one substantially comprised of a ferrite structure and fine martensite and to make the structure one where fine martensite is dispersed in the ferrite structure.

The present invention was made based on the above discovery and has as its gist the following.

(1) Steel plate with small occurrence of the Bauschinger effect characterized by having a dual-phase structure substantially comprising a ferrite structure and fine martensite and the fine martensite being present dispersed in the ferrite structure.

(2) Steel plate with small occurrence of the Bauschinger effect as set forth in (1), wherein the fine martensite has grains with a long axis of 10 μm or less and said fine martensite has an area ratio of 10 to 30%.

(3) Steel plate with small occurrence of the Bauschinger effect as set forth in (1) or (2), wherein a ratio of the proportional limit of the compression stress-strain curve before and after being subjected to deformation is 0.7 or more.

(4) Steel plate with small occurrence of the Bauschinger effect as set forth in any one of (1) to (3), containing, by mass %, C: 0.03 to 0.30%, Si: 0.01 to 0.8%, Mn: 0.3 to 2.5%, P: 0.03% or less, S: 0.01% or less, Al: 0.001 to 0.1%, N: 0.01% or less and a balance of iron and unavoidable impurities.

(5) Steel plate with small occurrence of the Bauschinger effect as set forth in (4), further containing, by mass %, one or more of Nb: 0.1% or less, V: 0.3% or less, Mo: 0.5% or less, Ti: 0.1% or less, Cr: 1.0% or less, Ni: 1.0% or less, Cu: 1.0% or less, B: 0.003% or less, and Ca: 0.004% or less.

(6) Steel plate with small occurrence of the Bauschinger effect as set forth in (4) or (5), further containing, by mass %, C: 0.03 to 0.10%, having a Charpy V-notch value in the transverse direction at −20° C. of 40 J or more, and having a ratio of the proportional limit of the compression stress-strain curve before and after being subjected to deformation of 0.7 or more.

(7) Steel pipe with small occurrence of the Bauschinger effect, wherein the base material has a dual-phase structure substantially comprising a ferrite structure and fine martensite which is dispersed in the ferrite structure.

(8) Steel pipe with small occurrence of the Bauschinger effect as set forth in (7), wherein the fine martensite has grains of a long axis of 10 μm or less and said fine martensite has an area ratio of 10 to 30%.

(9) Steel pipe with small occurrence of the Bauschinger effect as set forth in (7) or (8), wherein a ratio of the proportional limit of the compression stress-strain curve in the circumferential direction before and after expansion of the steel pipe is 0.7 or more.

(10) Steel pipe with small occurrence of the Bauschinger effect as set forth in any one of (7) to (9), containing, by mass %, C: 0.03 to 0.30%, Si: 0.01 to 0.8%, Mn: 0.3 to 2.5%, P: 0.03% or less, S: 0.01% or less, Al: 0.001 to 0.1%, N: 0.01% or less, and a balance of iron and unavoidable impurities.

(11) Steel pipe with small occurrence of the Bauschinger effect as set forth in (10), further containing, by mass %, one or more of Nb: 0.1% or less, V: 0.3% or less, Mo: 0.5% or less, Ti: 0.1% or less, Cr: 1.0% or less, Ni: 1.0% or less, Cu: 1.0% or less, B: 0.003% or less, and Ca: 0.004% or less.

(12) Steel pipe with small occurrence of the Bauschinger effect as set forth in (10) or (11), further containing, by mass %, C: 0.03 to 0.10%, having a Charpy V-notch value in the transverse direction at −20° C. of 40 J or more, and having a ratio of the proportional limit of the compression stress-strain curve before and after being subjected to deformation of 0.7 or more.

(13) A method of production of steel plate with small occurrence of the Bauschinger effect as set forth in (5), comprising heating steel plate containing, by mass %, C: 0.03 to 0.30%, Si: 0.01 to 0.8%, Mn: 0.3 to 2.5%, P: 0.03% or less, S: 0.01% or less, Al: 0.001 to 0.1%, and N: 0.01% or less and further, optionally, one or more of Nb: 0.1% or less, V: 0.3% or less, Mo: 0.5% or less, Ti: 0.1% or less, Cr: 1.0% or less, Ni: 1.0% or less, Cu: 1.0% or less, B: 0.003% or less, and Ca: 0.004% or less, and a balance of iron and unavoidable impurities, to 760 to 830° C., then quenching it.

(14) A method of production of steel pipe with small occurrence of the Bauschinger effect as set forth in (11), comprising heating steel pipe having a base material comprised of as ingredients, by mass %, C: 0.03 to 0.30%, Si: 0.01 to 0.8%, Mn: 0.3 to 2.5%, P: 0.03% or less, S: 0.01% or less, Al: 0.001 to 0.1%, and N: 0.01% or less and further, optionally, one or more of Nb: 0.1% or less, V: 0.3% or less, Mo: 0.5% or less, Ti: 0.1% or less, Cr: 1.0% or less, Ni: 1.0% or less, Cu: 1.0% or less, B: 0.003% or less, and Ca: 0.004% or less, and a balance of iron and unavoidable impurities, to 760 to 830° C., then quenching it.

(15) A method of production of steel pipe with small occurrence of the Bauschinger effect as set forth in (11), comprising hot rolling a steel slab containing, by mass %, C: 0.03 to 0.30%, Si: 0.01 to 0.8%, Mn: 0.3 to 2.5%, P: 0.03% or less, S: 0.01% or less, Al: 0.001 to 0.1%, and N: 0.01% or less and further, optionally, one or more of Nb: 0.1% or less, V: 0.3% or less, Mo: 0.5% or less, Ti: 0.1% or less, Cr: 1.0% or less, Ni: 1.0% or less, Cu: 1.0% or less, B: 0.003% or less, and Ca: 0.004% or less and a balance of iron and unavoidable impurities to obtain a steel plate, roll-forming this into a tubular shape, electric-resistance-welding its seam to obtain ERW pipe, heating to 760 to 830° C., then water cooling.

(16) A method of production of steel pipe with small occurrence of the Bauschinger effect as set forth in (15), further comprising, after the ERW, heat treating the seam by heating the seam weld zone to the $Ac_3$ point or more, heating to 760 to 830° C., then water cooling.

(17) A method of production of steel pipe with small occurrence of the Bauschinger effect as set forth in (15) or (16), wherein the hot rolled steel plate has a ferrite+pearlite structure or ferrite+bainite structure.

BEST MODE FOR WORKING THE INVENTION

Figure 1:
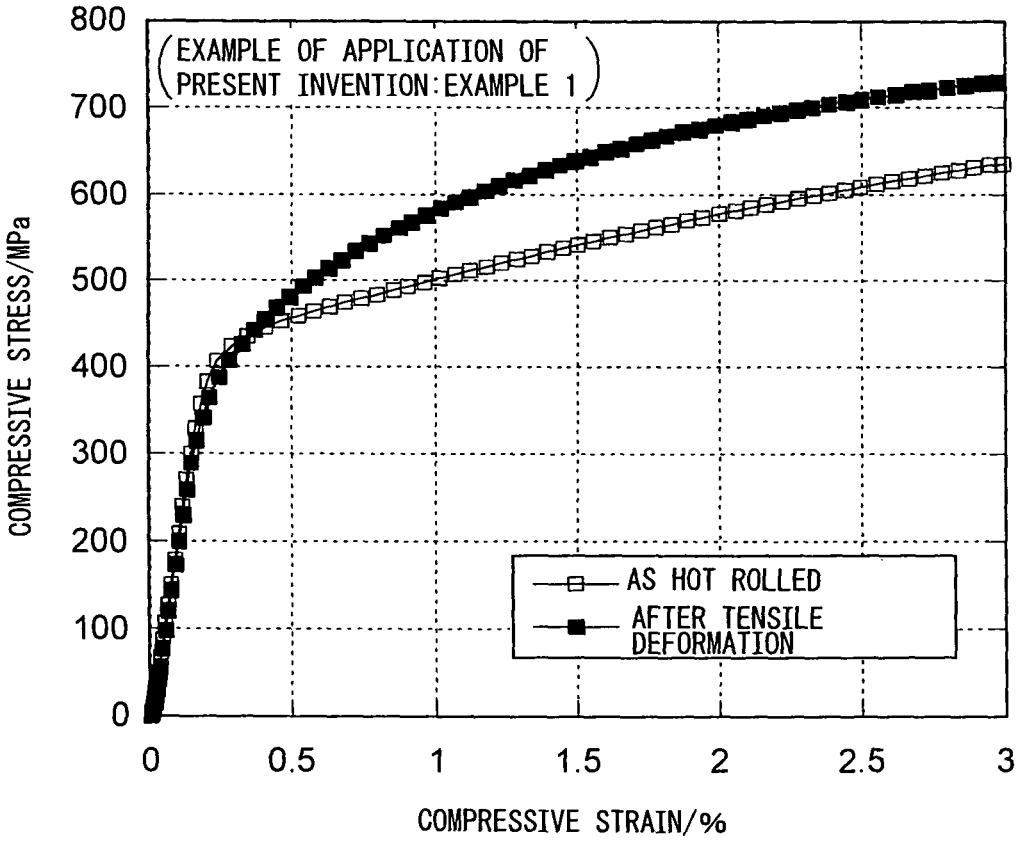
FIG. 1 is a view showing the stress-strain curve of sheet plate (steel pipe) according to the present invention (Example 1).

The inventors studied in detail the effects of the method of production of steel plate and steel pipe, the microstructure, and chemical ingredients on the occurrence of the Bauschinger effect. For the basic study, they conducted compression tests using compression test pieces obtained from the materials as they were and compression test pieces obtained by obtaining tensile test pieces from the materials, imparting 8% tensile strain, and further machining them and compared with the two for stress-strain curves, proportional limit, 0.1% offset yield strength, and 0.2% offset yield strength.

In particular, the ratio of the proportional limit of a material itself (PL-b) and the proportional limit after tensile deformation (PL-a), that is, (PL-a)/(PL-b), is called the "Bauschinger effect ratio". The higher this value, the smaller the occurrence of the Bauschinger effect indicated. Note that in the present invention, for the proportional limits (PL-b) and (PL-a), 0.05% offset yield strength was used as the apparent proportional limit.

The microstructure was observed using an optical microscope and scan type electron microscope. Note that the samples used for observation of the microstructure were obtained from the centers of thicknesses of the steel plates or steel pipes to give, in the case of steel plate, cross-sections in the direction vertical to the rolling direction as the observed surfaces and, in the case of steel pipe, cross-sections in the circumferential direction as the observed surfaces. The observed surfaces of the samples were mirror polished, then etched by Nital.

The low alloy steels shown in Table 1 were produced by the methods shown in Table 2 to obtain Example 1 to Example 3. Compressive test piece (diameter 8 mm, height 18 mm) and tensile test pieces (rods of diameter 10 mm and length of parallel part of 30 mm) were prepared from these.

TABLE 1

| | C | Si | Mn | Cr | Nb | Al | Ti | B (mass %) |
|---|---|---|---|---|---|---|---|---|
| A | 0.09 | 0.21 | 1.21 | | 0.03 | 0.03 | | |
| B | 0.27 | 0.14 | 1.28 | 0.14 | | 0.04 | 0.02 | 0.0015 |

TABLE 2

| | Steel | Method of production | Microstructure | PL-b | PL-a | PL-a/PL-b Bauschinger effect ratio | |
|---|---|---|---|---|---|---|---|
| Inv. ex. | A | Hot rolling (ferrite + pearlite structure), then heating to 780° C. and water cooling | Ferrite + martensite | 400 MPa | 360 MPa | 0.9 | Ex. 1 |
| Comp. Ex. | A | Hot rolling alone | Ferrite + pearlite | 400 MPa | 270 MPa | 0.68 | Ex. 2 |
| | B | Quenching from 930° C., tempering at 700° C. | Tempered martensite | 630 MPa | 200 MPa | 0.22 | Ex. 3 |

An extensometer was attached to the parallel part or each tensile test piece, a tensile tester was used to impart 8% strain, then the parallel part was machined to a diameter of 8 mm to prepare a compressive test piece. Compressive test pieces to which tensile strain was introduced and compressive test pieces as worked were used for compression tests, the stress-strain curves of compression were measured, and the apparent proportional limits (0.05% offset yield strengths) were measured. The strain in the compression tests was measured by attaching a strain gauge every 120 degrees on the cylindrical side surfaces and using their average value.

Figure 2:
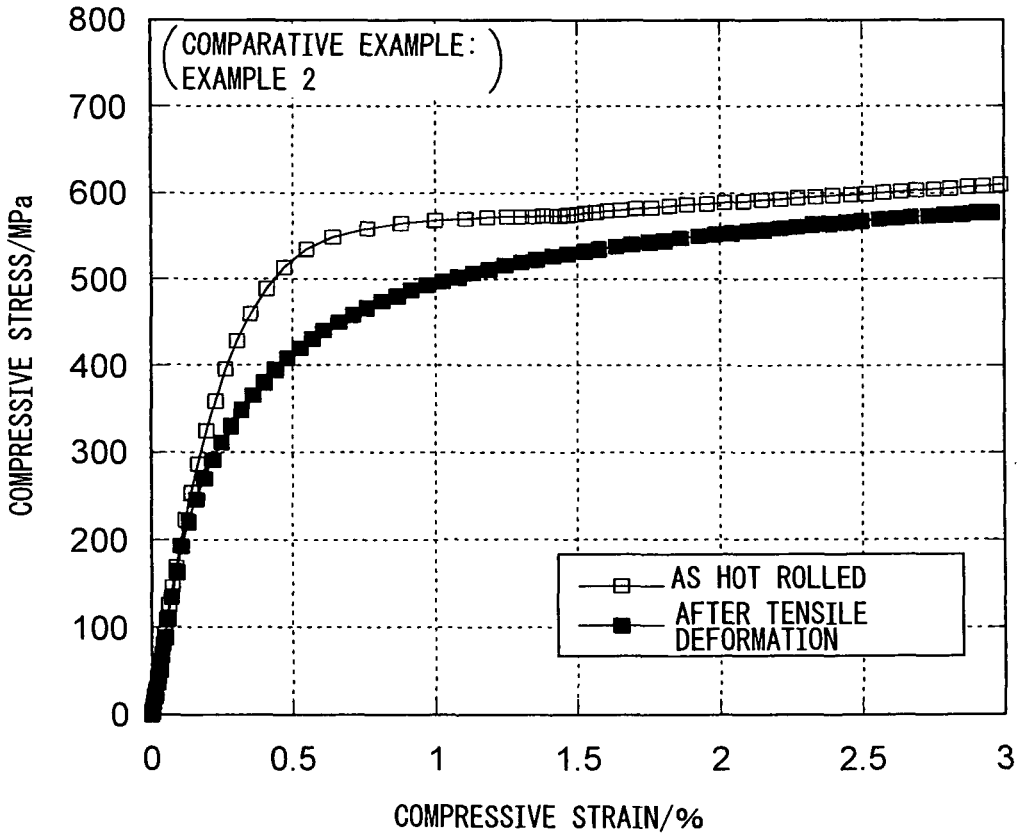
FIG. 2 is a view showing the stress-strain curve of sheet plate (steel pipe) as hot rolled according to the prior art (Example 2).
Figure 3:
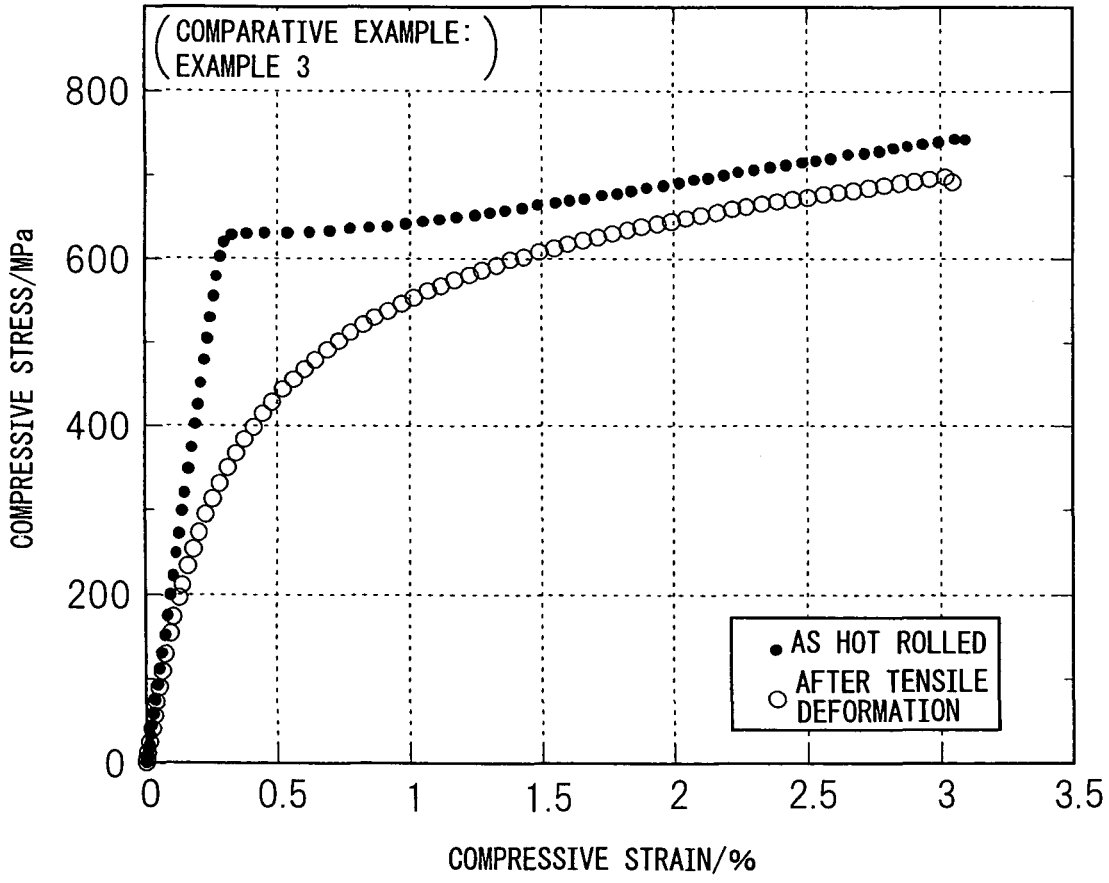
FIG. 3 is a view showing the stress-strain curve of steel plate (steel pipe) made of Cr—Mo steel according to the prior art (Example 3).

Examples of the stress-strain curves of Example 1 to Example 3 are shown in FIGS. 1 to 3. In Example 1, as shown in FIG. 1, there is no change in the shape of the stress-strain curve before and after tensile deformation until near 450 MPa. In Example 2 and Example 3, as shown in FIG. 2 and FIG. 3, the compression stress-strain curves after tensile deformation greatly fall in proportional limit. This is particularly remarkable in Example 3.

Figure 4A:
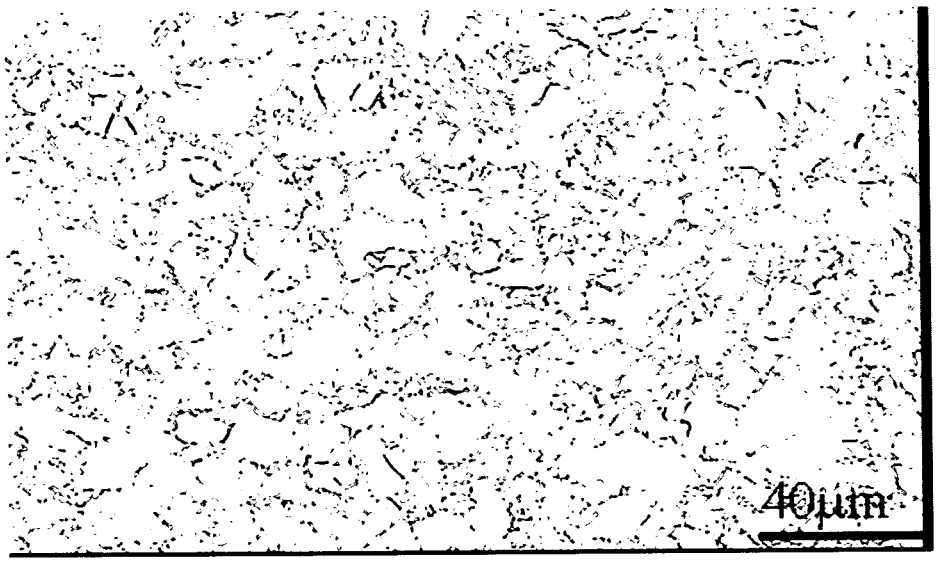
FIG. 4 gives in (a) an optical micrograph of the structure of steel plate (steel pipe) according to the present invention (Example 1) and in (b) a scan electron micrograph of steel plate (steel pipe) according to the present invention (Example 1).
Figure 4B:
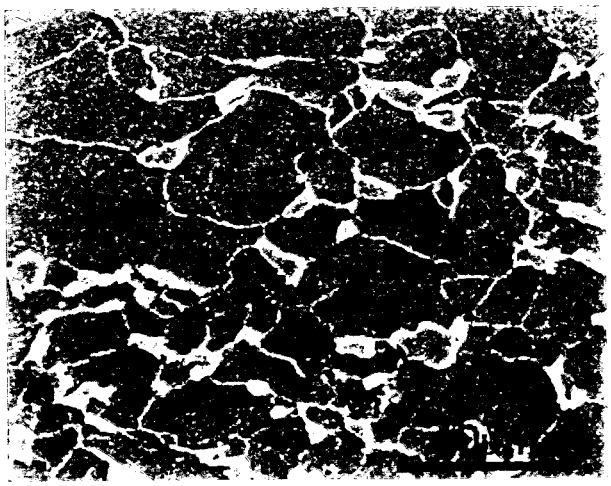
Figure 5:
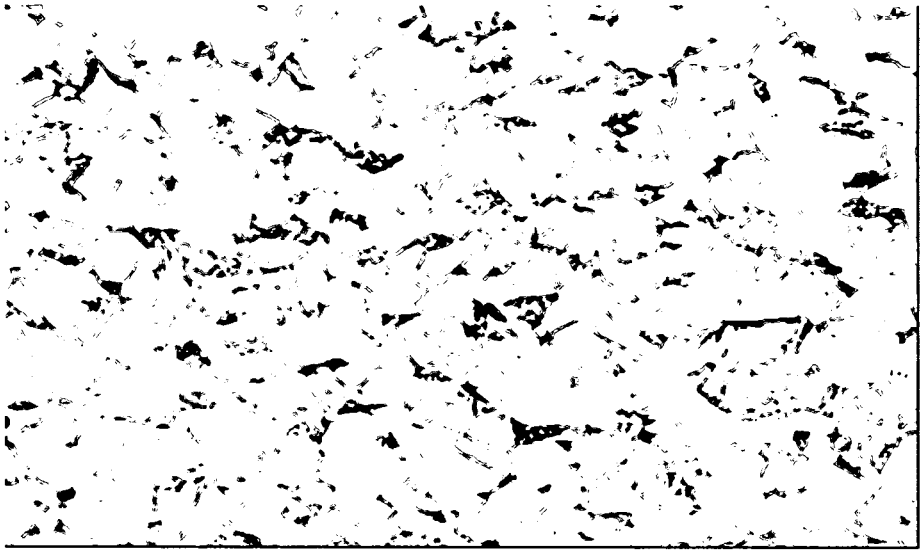
FIG. 5 is an optical micrograph of the structure of steel plate (steel pipe) as hot rolled according to the prior art (Example 2).
Figure 6:
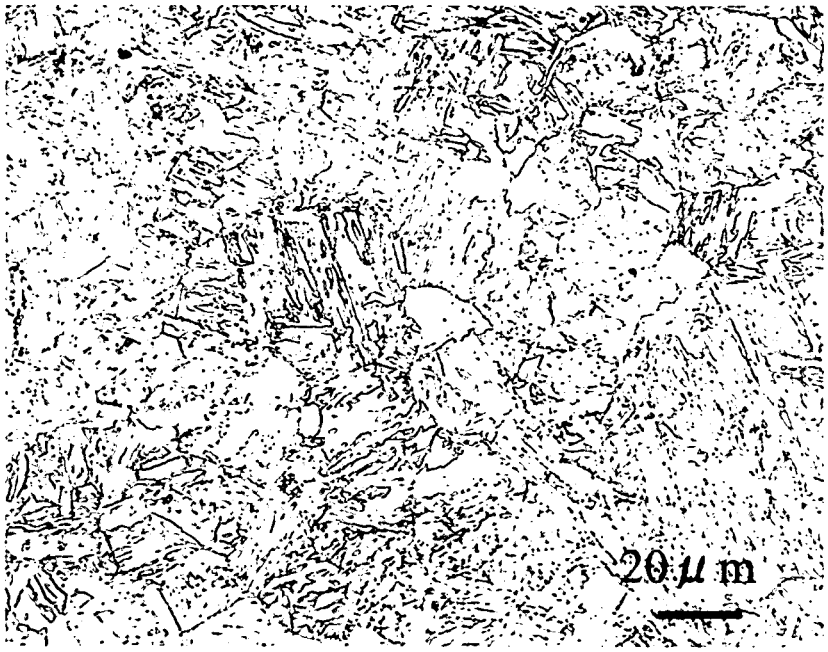
FIG. 6 is an optical micrograph of the structure of steel plate (steel pipe) made of Cr—Mo steel (annealed martensite structure) according to the prior art (Example 3).

Micrographs of the structures of Examples 1 to 3 are shown in FIGS. 4 to 6. The microstructure of Example 1, as shown by the optical micrograph of FIG. 4(*a*) and the scan type electron micrograph of FIG. 4(*b*), is a ferrite structure in which fine martensite of several μm size is dispersed so as to give a dual-phase structure. The scan type electron micrograph enlarged 2000× of Example 1 shown in FIG. 4(*b*) does not reveal any fine carbides, so the microstructure of Example 1 does not include any pearlite, cementite, bainite, or martensite and austenite mixtures (martensite austenite constituents, called "MA") etc. and is clearly a dual-phase structure comprised substantially only of the two phases of a ferrite structure and fine martensite. On the other hand, the microstructure of Example 2, as shown in FIG. 5, is a ferrite+pearlite structure. Example 3, as shown in FIG. 5, is a tempered martensite structure.

As shown in Table 2, ferrite+martensite dual-phase steel having a dual-phase structure substantially comprised of a ferrite structure and fine martensite (Invention Example A) has a high Bauschinger effect ratio, followed by ferrite+pearlite steel having a dual-phase structure of ferrite and pearlite (Comparative Example A), and then tempered martensite (Comparative Example B) with the lowest Bauschinger effect ratio. In this way, steel having a dual-phase structure has a large Bauschinger effect ratio. In particular, when the second phase is martensite, the Bauschinger effect ratio becomes the largest. That is, steel having a dual-phase structure of ferrite+martensite has the smallest occurrence of the Bauschinger effect.

Note that if steel having a dual-phase structure ferrite+martensite is formed with a small amount of a coarse martensite phase, not only is occurrence of the Bauschinger effect hard to suppress, but also the low temperature toughness falls, so the martensite has to be formed finely dispersed in the ferrite structure. Due to this, it is believed that the fine martensite dispersed in the ferrite structure restrains deformation of the ferrite grains and thereby occurrence of the Bauschinger effect is suppressed.

Below, the present invention will be explained in detail. In the present invention, to minimize the occurrence of the Bauschinger effect, it is necessary to make the structure of the steel one of a ferrite structure in which fine martensite is dispersed so as to obtain a dual-phase structure substantially comprised of a ferrite structure and fine martensite. Here, the fine martensite being present dispersed in the ferrite structure means, as shown in the optical micrograph shown in FIG. 4(*a*) and the scan type electron micrograph shown in FIG. 4(*b*), the fine martensite is not segregated in the ferrite structure. Preferably, the distances between the martensite grains are substantially uniform.

Note that in the present invention, having the dual-phase structure substantially comprised of a ferrite structure and fine martensite means that when observing the structure enlarged 2000× by a scan type electron microscope, no structures including carbides can be observed in the micrographs of about five fields. When observed by a scan type electron microscope, carbides are possibly observed. Further, in the present invention, the state of a ferrite structure in which fine martensite is dispersed is defined as one where, when observing the structure enlarged 500× by an optical microscope, there is no martensite structure present in the same way as the micrograph shown in FIG. 4(*a*) in the micrographs of about five fields photographed.

Next, if there are grains of martensite with long axes exceeding 10 μm, the effect of suppression of occurrence of the Bauschinger effect and the toughness will drop somewhat. Therefore, the fine martensite preferably has grains with a long axis of 10 μm or less. On the other hand, the effect of suppression of occurrence of the Bauschinger effect is particularly remarkable with the fine martensite having grains with a long axis of 1 μm or more. Here, the "long axis of grains of martensite" means the maximum distance between adjoining or facing peaks of grains and can be found from a scan type electron micrograph illustrated in FIG. 4(*b*).

Further, if the fine martensite has an area ratio less than 10%, the strength falls somewhat, while if over 30%, the effect of suppression of the occurrence of the Bauschinger effect and the toughness drop somewhat, so the ratio is preferably 10 to 30%.

Further, the ferrite structure preferably has grains of sizes of 10 to 20 μm. This is because obtaining a ferrite structure with grains of a size of less than 10 μm would require hot rolling at a low temperature and would otherwise impair the manufacturability, while obtaining a ferrite structure with grains of a size over 20 μm would impair the toughness. The grain size of a ferrite structure can be found by the cutting method based on JIS G 0552.

The effect of the present invention on the Bauschinger effect is no different for steel plate and steel pipe. Further, similar effects to the present invention are naturally exhibited in steel shapes and other shapes as well.

To obtain the steel plate or steel pipe with small occurrence of the Bauschinger effect aimed at by the present invention, it is preferable to make the composition of the chemical ingredients one in the range particularly explained below.

C is an element raising the hardenability and improving the strength of the steel. The lower limit required for obtaining the targeted strength and ferrite-martensite structure is 0.03%. However, if the amount of C is too great, with the process of the present invention, the strength becomes too high and further a remarkable deterioration in the low temperature toughness is invited, so the upper limit was made 0.30%. In particular, when a high low temperature toughness is required, the upper limit of the amount of C is preferably made 0.10%.

Si is an element added for deoxidation and improving the strength, but if too much is added, it will cause remarkable degradation of the low temperature toughness, so the upper limit was made 0.8%. Steel can be sufficiently deoxidized by Al or Ti as well. Si does not necessarily have to be added. Therefore, there is no need to define a lower limit, but usually this is included in an amount of 0.01% or more as an impurity, so the limit was set at 0.01%.

Mn is an essential element for increasing the hardenability and securing high strength. The lower limit is 0.3%. However, if the amount of Mn is too great, it promotes segregation and results in the fine martensite being dispersed in a layered manner thereby obstructing homogeneous dispersion, so the upper limit was made 2.5%.

Al is an element usually included in steel as a deoxidizing material and has an effect on increasing the fineness of the structure as well. However, if the amount of Al exceeds 0.1%, the Al-based nonmetallic inclusions increase and impair the cleanliness of the steel, so the upper limit was made 0.1%. However, deoxidation is also possible by Ti or Si. Al does not necessarily have to be added. Therefore, the lower limit does not have to be set, but usually this is included in an amount of 0.001% or more as an impurity, so the lower limit was made 0.001% or more.

N forms TiN, suppresses the coarsening of the austenite grains at slab reheating, and thereby improves the low temperature toughness of the base material. To obtain this effect, N is preferably added in an amount of 0.001% or more. However, if the amount of N is too great, the TiN coarsens and surface defects, degraded toughness, and other problems arise, so the upper limit has to be kept to 0.01%.

Further, in the present invention, the amounts of the impurity elements P and S are made 0.03% and 0.01% or less. The main reason is to further improve the low temperature toughness of the base material and improve the toughness of the weld zone. Reduction of the amount of P reduces the center segregation of continuously cast slabs and prevents grain boundary destruction to thereby improve the low temperature toughness. Further, reduction of the amount of S has the effect of reducing the MnS flattened by hot rolling and improving the ductility and toughness. P and S are both preferably small, but have to be determined by the balance of characteristics and cost.

Next, the purposes of adding the optional elements Nb, Ti, Ni, Mo, Cr, Cu, V, B, and Ca will be explained. The main reasons these elements are added are to further improve the strength and toughness and enlarge the size (thickness) of the steel material able to be produced without impairing the excellent features of the steel of the present invention. No particular lower limits are defined, but the effects of addition become remarkable with amounts of addition of about one-tenth the upper limit values.

Nb not only suppresses recrystallization of the austenite at the time of rolling so as to make the microstructure finer, but also contributes to the increase in the hardenability and makes the steel tougher. Further, it contributes to the recovery from the Bauschinger effect by aging. The amount of addition of Nb is preferably 0.01% or more to obtain this effect. If much larger than 0.1%, it has a detrimental effect on the low temperature toughness, so the upper limit is preferably made 0.1%.

Addition of Ti forms fine TiN and suppresses the coarsening of the austenite grains at slab reheating to make the microstructure finer and improve the low temperature toughness. Further, if the amount of Al is for example a low 0.005% or less, Ti also has the effect of forming oxides and deoxidizing the steel. To obtain these effects, this is preferably added in an amount of 0.01% or more, but if the amount of Ti is too great, coarsening of the TiN and precipitation hardening due to the TiC occurs and the low temperature toughness is degraded, so the upper limit is preferably made 0.1%.

Ni is added for the purpose of suppressing deterioration of the low temperature toughness. Addition of Ni, compared with addition of Mn or Cr and Mo, seldom forms hard structures detrimental to the low temperature toughness in the rolled structure, in particular the center segregation zone of a continuously cast slab. To obtain these effects, addition of 0.1% or more is preferable, but if the amount of addition is too great, the microstructure of the steel before the heat treatment becomes a martensite-bainite system, so the upper limit is preferably made 1.0%.

Mo is added to improve the hardenability of the steel and obtain high strength. Further, it acts to promote the recovery from the Bauschinger effect due to low temperature aging at about 100° C. To obtain these effects, 0.05% or more is preferably added, but excessive Mo addition results in the microstructure of the steel before heat treatment becoming a martensite-bainite system, so the upper limit is preferably made 0.5%.

Cu is added for the purpose of suppressing deterioration of the low temperature toughness. Addition of Cu, compared with addition of Mn or Cr and Mo, seldom forms hard structures detrimental to the low temperature toughness in the rolled structure, in particular the center segregation zone of a continuously cast slab. To obtain these effects, 0.1% or more is preferably added, but if the amount of addition is too great, the microstructure of the steel before the heat treatment will become a martensite-bainite system, so the upper limit is preferably made 1.0%.

Cr is added to increase the strength of the base material and the weld zone. To obtain this effect, 0.1% or more is preferably added, but if the amount of Cr is too great, the microstructure of the steel before heat treatment becomes a martensite-bainite system, so the upper limit is preferably made 1.0%.

V has substantially the same effect as Nb. To obtain this effect, 0.01% or more is preferably added, but if the amount of addition is too great, it causes the low temperature toughness to deteriorate, so the upper limit is preferably made 0.3%.

B has the effect of increasing the hardenability. To obtain this effect, 0.0003% or more is preferably added, but if the amount of addition is too great, not only does the hardening effect conversely fall, but also the low temperature toughness falls or the slab more easily cracks, so the upper limit is preferably made 0.003%.

Ca has the effect of preventing coarsening of the oxides and improving the pipe expandability. To obtain this effect, 0.0004% or more is preferably added. Addition of 0.001% or more causes a more remarkable effect to be occurred. On the other hand, if the amount of addition of Ca is too great, coarse Ca oxides are formed and the pipe expandability falls in some cases, so the upper limit is preferably made 0.004% or less.

Next, a method of production of steel having the dual-phase structure of ferrite+martensite of the present invention will be explained. The dual-phase ferrite+martensite steel of the present invention can be obtained by heating steel to the dual-phase region of austenite and ferrite, then quenching the steel. If the heating temperature is too low, martensite is not formed, while if too high, the rate of transformation to austenite becomes too great and the amount of C in the austenite becomes lower, so martensite can no longer be transformed to during the quenching. Therefore, the heating temperature is optimally 760 to 830° C. Note that the quenching after heating to the dual-phase region is preferably performed by water cooling.

Further, the dual-phase ferrite+martensite steel is easily roll-formed if the microstructure before heating is a ferrite+pearlite or ferrite+bainite structure. To make the microstructure of the steel plate before heating, as comprised of hot rolled steel plate, a ferrite+pearlite structure, it is sufficient to set the coiling temperature after hot rolling to 700 to 500° C. To obtain a ferrite+bainite structure, it is sufficient to set the cooling start temperature after hot rolling at 750° C. or less and set the coiling temperature to 500° C. or less.

The steel pipe able to be used in the present invention includes seamless steel pipe, UOE steel pipe made by shaping steel plate into a tube and arc welding the end faces, etc., but seam-welded (ERW) pipe is preferable. The reason is that ERW pipe is produced from hot rolled steel plate as a material, so the thickness is uniform and, compared with seamless steel pipe, there are the features of excellent pipe expandability and crushing strength. If steel pipe is uniform in thickness, its expandability and crushing strength are improved. On the other hand, if it is not uniform in thickness, it will easily bend when expanded.

The seam-weld zone is a part which is heated, compressed, and rapidly cooled, so forms a fine uniform structure. Compared with a mainly ferrite+pearlite base material and weld heat affected zone, the microstructure does not easily become a ferrite+martensite dual-phase structure after heating to 760 to 830° C. If heating the vicinity of the seam, that is, the seam weld zone, once to the $Ac_3$ point or more, the microstructure will approach a ferrite+pearlite structure, the pipe body is heated to the austenite+ferrite dual-phase region and quenched. The microstructure of the subsequent seam weld zone then becomes close to the structure of the base material and weld heat affected zone.

When using the steel pipe obtained according to the present invention for expandable tubular applications, it is necessary to expand the pipe to a high expansion rate. The steel pipe having a dual-phase structure a ferrite structure in which fine martensite is dispersed of the present invention is excellent in deformation characteristics and, further, has a high work hardening rate and is resistant to local deformation, so can be expanded by a rate of 45%.

EXAMPLES

Hot rolled steel plates having the chemical ingredients shown in Table 3 were used to produce ERW pipes of diameters of 194 mm and thicknesses of 9.6 mm. The hot rolling heating temperature was made 1200° C., the hot rolling finish temperature was made 850° C., and the sheets were coiled after 600° C. after water cooling at the runout table. The microstructures of the hot rolled steel sheets were changed by changing the cooling conditions etc.

Further, as shown in Table 4, part of the ERW pipes were heat treated at the seams. These steel pipes were heated under the conditions shown in Table 4, then were rapidly water cooled. Samples were taken from the base materials of these steel pipes with the cross-sections in the circumferential directions as observed surfaces and optical micrographs and scan type electron micrographs were taken of the vicinities of the centers of thickness.

TABLE 3

(mass %)

| Steel | C | Si | Mn | P | S | Al | N | Nb | V | Mo | Ti | Cr | Ni | Cu | B | Ca |
|---|---|---|---|---|---|---|---|---|---|---|---|---|---|---|---|---|
| A | 0.09 | 0.21 | 1.21 | 0.012 | 0.003 | 0.03 | 0.005 | 0.03 | | | | | | | | |
| B | 0.27 | 0.14 | 1.28 | 0.015 | 0.005 | 0.04 | 0.003 | | | | 0.02 | | | | 0.0015 | 0.0012 |
| C | 0.14 | 0.08 | 1.65 | 0.008 | 0.001 | 0.02 | 0.004 | | | | | | | | | 0.0008 |
| D | 0.05 | 0.22 | 0.84 | 0.018 | 0.002 | 0.02 | 0.004 | | 0.05 | 0.12 | 0.01 | | | | | 0.0019 |
| E | 0.08 | 0.06 | 1.11 | 0.013 | 0.003 | 0.03 | 0.003 | 0.02 | | | | 0.2 | 0.2 | 0.2 | | |

TABLE 4

| | Test No. | Steel | Seam heat treatment | Heating temperature (then water cooling) | Tempering | Microstructure | Area ratio (%) | Martensite long axis (μm) | Circumferential direction Charpy value (J) | Bauschinger effect ratio |
|---|---|---|---|---|---|---|---|---|---|---|
| Inv. ex. | 1 | A | 920° C., water cooling | 780° C. | | Ferrite + martensite | 12 | 9 | 56 | 0.90 |
| | 2 | A | None | 820° C. | | Ferrite + martensite | 23 | 7 | 50 | 0.95 |
| | 3 | B | 920° C., natural cooling | 780° C. | | Ferrite + martensite | 16 | 12 | 27 | 0.82 |
| | 4 | C | 920° C., water cooling | 780° C. | | Ferrite + martensite | 13 | 8 | 38 | 0.87 |
| | 5 | D | 920° C., natural cooling | 800° C. | | Ferrite + martensite | 14 | 10 | 72 | 0.74 |
| | 6 | E | 920° C., natural cooling | 800° C. | | Ferrite + martensite | 17 | 9 | 70 | 0.77 |
| Comp. ex. | 7 | A | 920° C., water cooling | 780° C., natural cooling | | Ferrite + pearlite | | | 35 | 0.61 |
| | 8 | A | 920° C., water cooling | 780° C. | 500° C. | Ferrite + tempered martensite | | | 36 | 0.43 |
| | 9 | B | 920° C., natural cooling | 930° C. | 700° C. | Tempered martensite | | | 64 | 0.22 |

* Area ratio in the table is area ratio of fine martensite.
* Blank fields in table mean not yet performed A Charpy V-notch test piece was taken from each steel pipe before expansion using the circumferential direction as the long direction based on JIS Z 2202. This was subjected to a Charpy test at −20° C. based on JIS Z 2242. The absorption energy measured is shown in Table 4 as the circumferential direction Charpy value. Each steel pipe was expanded 20%. A compression test piece (diameter 8 mm, height 18 mm) was taken from each steel pipe before and after expansion using the circumferential direction as the long direction and was subjected to a compression test with the circumferential direction as the compression direction. The 0.05% offset yield strengths were measured to calculate the Bauschinger effect ratio. The test results are shown in Table 4. Note that it was confirmed that the steel pipe of the present invention can be expanded up to a rate of 45%.

Further, part of the 20% expanded steel pipes were used for crushing tests where the crushing pressures were measured. The crushing tests were performed based on API 5C3 with a ratio of the diameter and test piece length of 8. The results of the crushing test for an invention steel (Test No. 1) and a comparative steel (Test No. 9) of Table 4 are shown in Table 5. The steel of the present invention is improved in crushing strength compared with the comparative steel. This is believed due to the suppression of the Bauschinger effect and the consequent improvement of the strength.

The steel pipe of the comparative example was made of quenched and tempered steel exhibiting a tempered martensite structure which is currently being used for expandable tubular applications.

TABLE 5

| | Test No. | Crushing pressure |
|---|---|---|
| Invention Example | 1 | 15.1 MPa |
| Comparative Example | 9 | 10.3 MPa |

INDUSTRIAL APPLICABILITY

The present invention can provide steel plate and steel pipe with small occurrence of the Bauschinger effect at the time of expansion for the production of ERW steel pipe such as line pipe for the transport of natural gas or crude oil or oil well pipe.

The invention claimed is:

1. A steel pipe formed from a plate of a steel base material, wherein the steel base material comprises, by mass %, C: 0.03 to 0.30%, Si: 0.01 to 0.8%, Mn: 0.3 to 2.5%, P: 0.03% or less, S: 0.01% or less, Al: 0.001 to 0.1%, N: 0.01% or less, and a balance of iron and unavoidable impurities, wherein the steel pipe is heated in the austenite-ferrite dual-phase temperature region and is then quenched, wherein the heating and the quenching are conducted after the plate of the steel base material is shaped into the steel pipe, and wherein the steel pipe has:

a dual-phase structure substantially comprising a ferrite structure and fine martensite dispersed at the ferrite grain boundaries, and a ratio of the proportional limit of the compression stress-strain curve in the circumferential direction before and after expansion of at least 0.7, wherein the fine martensite has grains of a long axis of 10 μm or less and said fine martensite has an area ratio of 10 to 30%.

2. The steel pipe as set forth in claim 1, wherein the pipe is heated at a temperature range of 760 to 830° C.

3. The steel pipe as set forth in claim 1, further containing, by mass %, one or more of Nb: 0.1% or less, V: 0.3% or less, Mo: 0.5% or less, Ti: 0.1% or less, Cr: 1.0% or less, Ni: 1.0% or less, Cu: 1.0% or less, B: 0.003% or less, and Ca: 0.004% or less.

4. The steel pipe as set forth in claim 1, further containing, by mass %, C: 0.03 to 0.10%, having a Charpy V-notch value in the transverse direction at −20° C. of 40 J or more, and wherein the ratio of the proportional limit of the compression stress-strain curve before and after being subjected to deformation is 0.7 or more.

* * * * *

UNITED STATES PATENT AND TRADEMARK OFFICE

CERTIFICATE OF CORRECTION

PATENT NO. : 8,815,024 B2
APPLICATION NO. : 10/588837
DATED : August 26, 2014
INVENTOR(S) : Hitoshi Asahi et al.

It is certified that error appears in the above-identified patent and that said Letters Patent is hereby corrected as shown below:

On the Title Page

Item (75), Inventors, change "Hitoshi Asahi, Futtsu (JP); Eiji Tsuru, Futtsu (JP)" to --Hitoshi Asahi, Chiba (JP); Eiji Tsuru, Chiba (JP)--.

Signed and Sealed this
Fourteenth Day of April, 2015

Michelle K. Lee

Michelle K. Lee
*Director of the United States Patent and Trademark Office*